US005251358A

United States Patent [19]

Moro et al.

[11] Patent Number: 5,251,358

[45] Date of Patent: Oct. 12, 1993

[54] VACUUM CLEANER WITH FUZZY LOGIC

[75] Inventors: Masaru Moro; Tadashi Matsuyo, both of Yokaichi; Seiji Yamaguchi, Shiga, all of Japan

[73] Assignee: Matsushita Electric Industrial Co., Ltd., Osaka, Japan

[21] Appl. No.: 796,316

[22] Filed: Nov. 22, 1991

[30] Foreign Application Priority Data

Nov. 26, 1990 [JP] Japan ..... 2-323679

[51] Int. Cl.[5] ..... G06F 9/44; A47L 9/28

[52] U.S. Cl. ..... 15/319; 395/900

[58] Field of Search ..... 395/3, 61, 900; 15/319

[56] References Cited

U.S. PATENT DOCUMENTS

| | | | |
|---|---|---|---|
| 4,601,082 | 7/1986 | Kurz | 15/319 |
| 4,654,924 | 4/1987 | Getz et al. | 15/319 |
| 4,841,815 | 6/1989 | Takahashi | 395/900 |
| 4,930,084 | 5/1990 | Hosaka et al. | 395/900 |

FOREIGN PATENT DOCUMENTS

| | | |
|---|---|---|
| 0217216 | 9/1986 | European Pat. Off. . |
| 0312111 | 10/1988 | European Pat. Off. . |
| 0397205 | 5/1990 | European Pat. Off. . |
| 3431164 | 2/1984 | Fed. Rep. of Germany . |
| 2225933 | 12/1989 | United Kingdom . |

OTHER PUBLICATIONS

European Patent Application 91403202.4 Search Report.

*Primary Examiner*—Allen R. MacDonald
*Assistant Examiner*—George Davis
*Attorney, Agent, or Firm*—Ratner & Prestia

[57] ABSTRACT

A vacuum cleaner comprising a fuzzy inferring device for determining a motor speed in response to the amount of dust, and means for holding the motor speed determined by the fuzzy inferring device for a predetermined period of time, whereby, after the motor speed is held for the predetermined period time, the motor is driven for a certain period of time at the speed subsequently determined by the fuzzy inferring device.

5 Claims, 8 Drawing Sheets

VACUUM CLEANER WITH FUZZY LOGIC

BACKGROUND OF THE INVENTION (a) Field of the Invention

The present invention relates to a vacuum cleaner comprising a fuzzy inferring device for reducing the sudden change of the number of rotations of a motor accommodated in the vacuum cleaner.

(b) Description of the Related Arts

In recent years, with the variety of objects such as a carpet to be cleaned, vacuum cleaners in which the number of rotations of a motor can be varied are increasingly manufactured. As the main current of the production of vacuum cleaners, a dust sensor is provided to control the number of rotations of the motor according to the amount of dust.

Conventionally, a vacuum cleaner of this kind has a construction as shown in FIG. 7. The construction of the vacuum cleaner is described below.

As shown in FIG. 7, a dust sensor 1 outputs pulse signals to a dust amount detecting means 2 when dust passes therethrough. The dust amount detecting means 2 counts pulse signals per unit time. A means 3 for setting the number of rotations sets the number of rotations of a motor 4. In response to the output of the motor 4, a control means 5 controls the rotation of the motor 4.

As shown in FIG. 8, the sensor 1 comprises a light emitting element 6 and a light receiving element 7. When light emitted by the light emitting element 6 is intercepted by dust which is passing between the light emitting element 6 and the receiving element 7, the intensity of light received by the receiving element 7 changes. The light receiving element 7 converts the change of the intensity of the light, thus outputting pulse signals.

Referring to FIGS. 9A and 9B, the operation of the means 3 for setting the number of rotations of the motor 4 is described below.

As shown in FIG. 9A, when the sensor 1 detects dust 8, the number of rotations of the motor 4 is set in correspondence with the amount of dust 8 as shown in Fig. 9B. When no dust is detected, the number of rotations of the motor 4 is set to $n_1$. When the amount of dust 8 is greater than $d_1$, the number of rotations of the motor 4 is set to $n_3$. When the amount of dust 8 is smaller than $d_1$, the number of rotations of the motor 4 is set to $n_2$.

According to the above-described vacuum cleaner, since the number of rotations of the motor 4 is successively varied according to the amount of dust 8 within unit time, it frequently occurs that the number of rotations of the motor 4 suddenly changes when the dust 8 is being intermittently detected. Consequently, the volume of sounds generated by the vacuum cleaner change suddenly. Thus, the conventional vacuum cleaner has problems in operation.

SUMMARY OF THE INVENTION

Accordingly, an essential object of the present invention is to provide a vacuum cleaner capable of preventing the number of rotations of a motor from changing suddenly irrespective of the change in the amount of dust so as to improve the operativeness of the vacuum cleaner.

In accomplishing these and other objects, there is provided a vacuum cleaner comprising: dust amount detecting means for detecting the amount of dust in response to a signal outputted thereto from a sensor provided in an air flow passage; comparing/counting means for performing a comparison and counting of the amount of dust; a fuzzy inferring device for determining the number of rotations of a motor, i.e., a motor speed in response to the output of the dust amount detecting means and the comparing/counting means; and means for holding the number of rotations of the motor determined by the fuzzy inferring device for a predetermined period of time. In the above construction, after the number of rotations of the motor is held for the predetermined period time, the motor is driven for a certain period of time at the number of rotations subsequently determined by the fuzzy inferring device.

According to another aspect of the present invention, there is provided a vacuum cleaner comprising: number of rotations comparing means, in response to the output of the fuzzy inferring device and the means for holding the number of rotations, for changing the number of rotations of the motor stepwise toward the number of rotations determined by the fuzzy inferring device after a predetermined period of time elapses.

According to the above-described construction, after a current number of rotations of the motor is kept for a predetermined period of time, the current number of rotations of the motor is changed according to the decision made by fuzzy inference. Accordingly, the number of rotations of the motor does not change suddenly.

BRIEF DESCRIPTION OF THE DRAWINGS

These and other objects and features of the present invention will become clear from the following description taken in conjunction with the preferred embodiments thereof with reference to the accompanying drawings, in which.

DETAILED DESCRIPTION OF THE INVENTION

Figure 1:
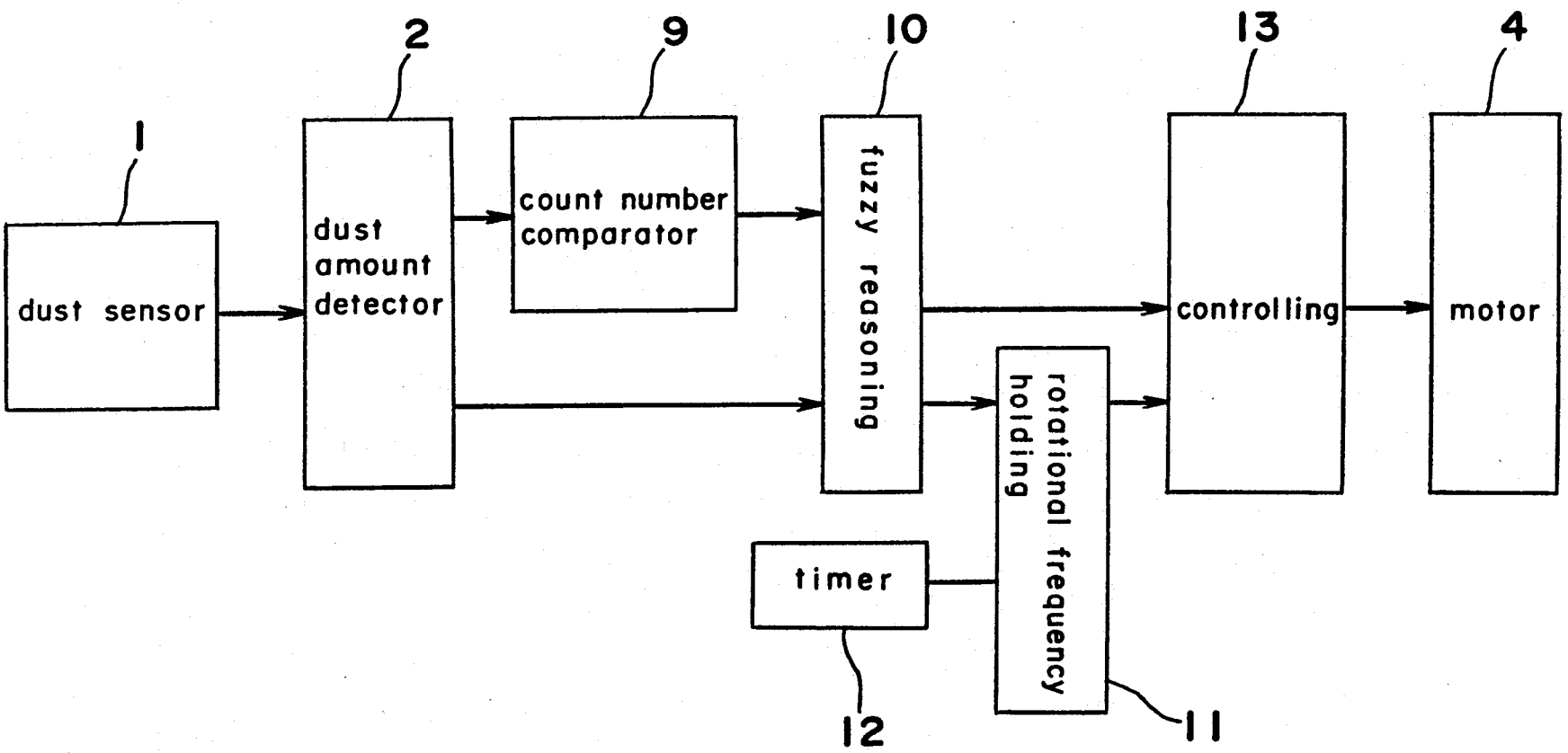
FIG. 1 is a block diagram showing a vacuum cleaner according to an embodiment of the present invention.

Before the description of the present invention proceeds, it is to be noted that like parts are designated by like reference numerals throughout the accompanying drawings.

An embodiment of the present invention will be described below with reference to FIGS. 1 and 2.

A comparing/counting means 9 counts, within unit time, how many times the amount of dust detected by a dust amount detecting means 2 has exceeded a predetermined amount for every predetermined period of time, thus outputting signals to a fuzzy inferring device 10. The fuzzy inferring device 10 performs fuzzy inference in response to signals outputted from the dust amount detecting means 2 and the comparing/counting means 9, thus determining the number of rotations of a motor 4, i.e., the motor speed. A means 11 for holding the number of rotations holds the number of rotations of the motor 4 determined by the fuzzy inferring device 10 for a certain period of time determined by a timer 12. The output of the means 11 for holding the number of rotations and the fuzzy inferring device 10 is sent to a control means 13. The control means 13 drives the motor 4 for a certain period of time according to the number of rotations determined by the fuzzy inferring device 10, and then, drives the motor 4 for a predetermined period of time according to the number of rotations which the fuzzy inferring device 10 has determined in response to a signal outputted subsequently from the dust amount detecting means 2. The control means 13 compares the number of rotations determined by fuzzy inference and the number of rotations held by the means 11 for holding the number of rotations with each other while the means 11 for holding the number of rotations is holding the number of rotations for a certain period of time.

Figure 2:
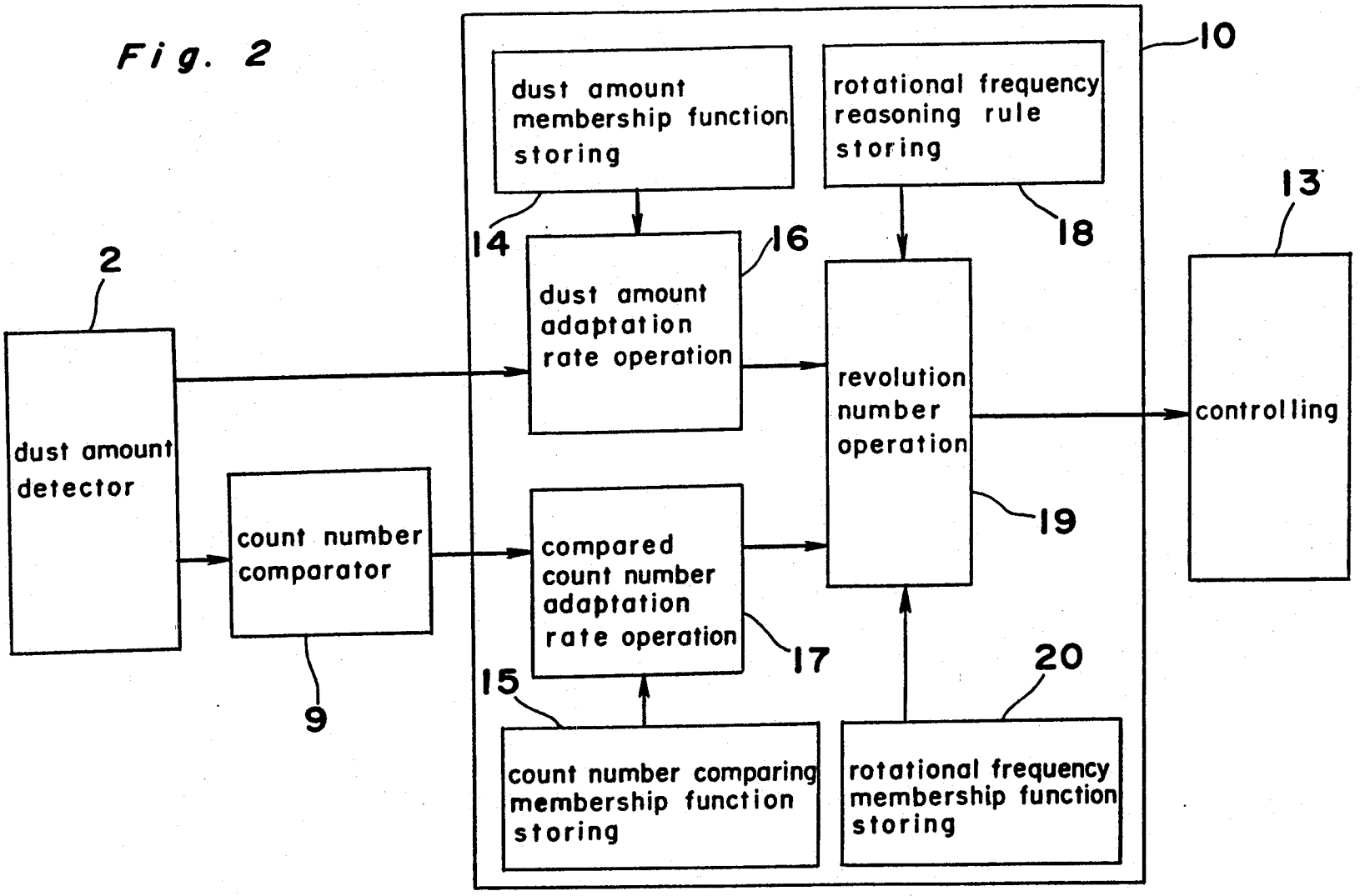
FIG. 2 is a block diagram showing a principal section of the vacuum cleaner.
Figure 3A:
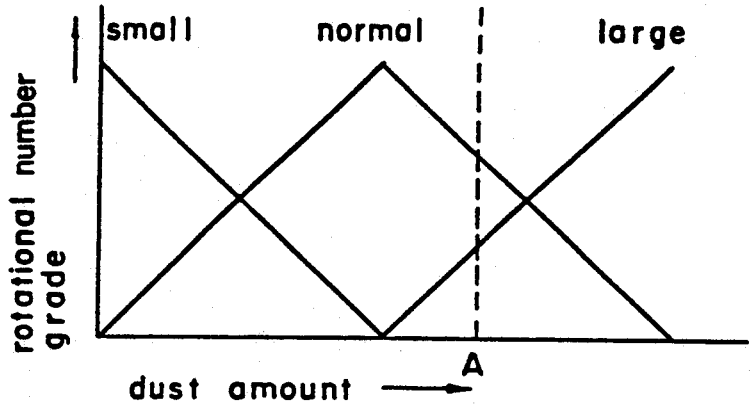
FIGS. 3A, 3B, and 3C are views showing membership functions stored in a fuzzy inferring device for controlling the number of rotations of a motor provided in the vacuum cleaner.
Figure 3B:
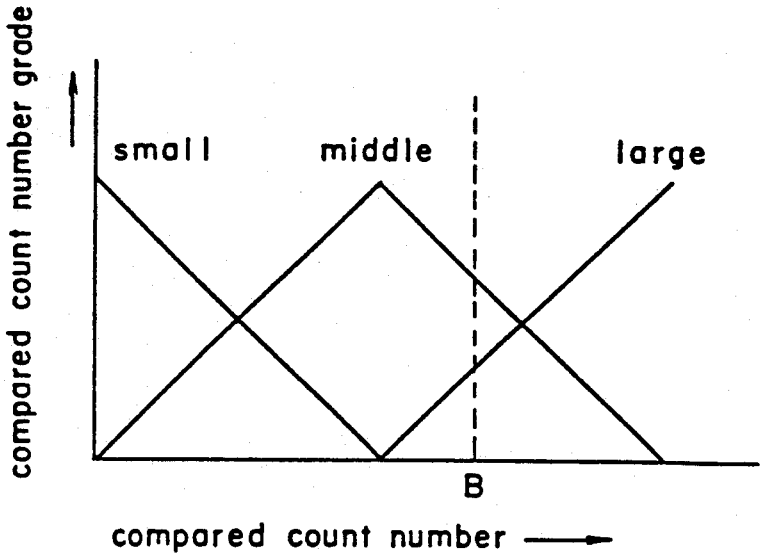
Figure 3C:
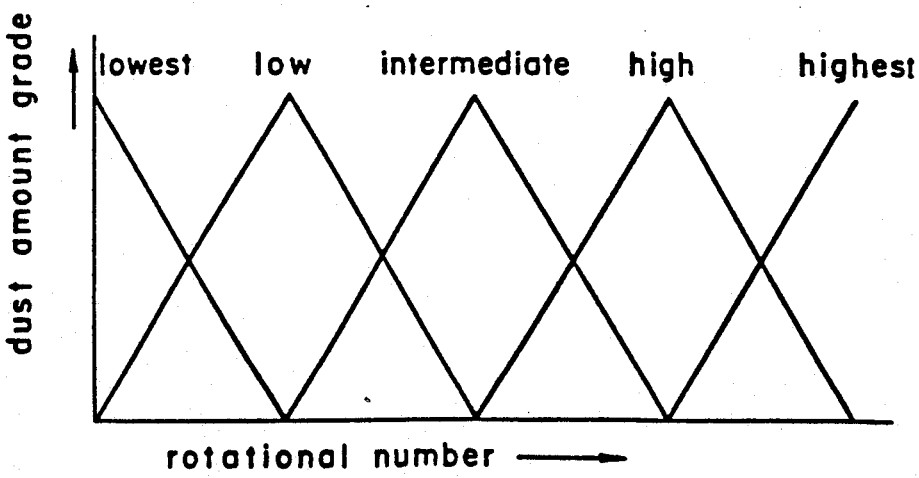

In the fuzzy inferring device 10 comprising means shown in FIG. 2, a means 19 for calculating the number of rotations compares a content stored in a means 18 for storing inference rule of the number of rotations with a signal outputted from a means 16 for calculating dust amount adaptation in response to a signal inputted thereto from a means 14 for storing dust amount membership function and a signal outputted from a means 17 for calculating comparing/counting adaptation in response to a signal inputted thereto from a means 15 for storing comparing/counting membership function with. Based on the result thus obtained, the most appropriate number of rotations is determined by selecting one membership function from a plurality of the number of rotations membership functions stored in a means 20 for storing the number of rotations membership function. The means 14 for storing dust amount membership function, the means 15 for storing comparing/counting membership function, and the means 20 for storing the number of rotations membership function store membership functions shown in FIG. 3A, membership functions shown in FIG. 3B, and membership functions shown in FIG. 3c, respectively. The means 18 storing inference rule of the number of rotations stores the inference rule of the number of rotations shown in Table 1.

TABLE 1

| | dust amount | | |
|---|---|---|---|
| comparison/counting | small | medium | large |
| small | slow | rather slow | medium |
| medium | rather slow | medium | rather fast |
| large | medium | rather fast | fast |

Although not shown, the means 19 for calculating the number of rotations comprises an antecedent section minimum calculating means, a consequent section maximum calculating means, and a center of gravity calculating means. The antecedent section minimum calculating means receives the output of the means 16 for calculating dust amount adaptation, the output of the means 17 for calculating comparing/counting adaptation, and the content stored in the means 18 for storing inference rule of the number of rotations. The consequent section maximum calculating means receives the output of the antecedent section minimum calculating means, the content stored in the means 18 for storing inference rule of the number of rotations, and the content stored in the means 20 for storing the number of rotations membership function. The center of gravity calculating means receives the output of the consequent section maximum calculating means.

Figure 4A:
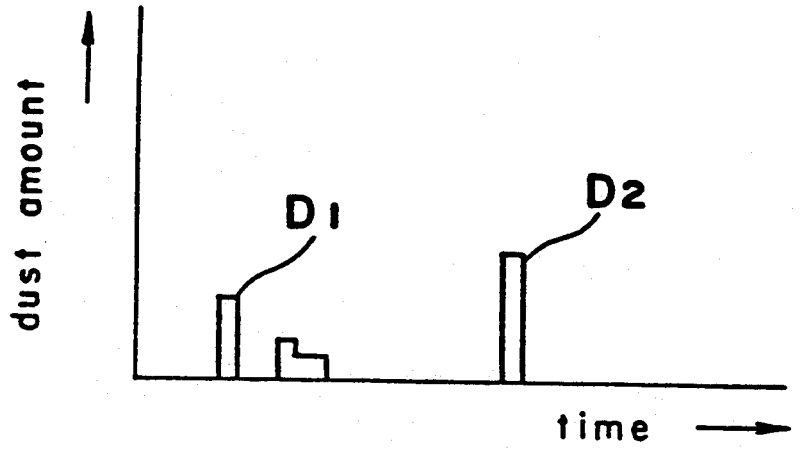
FIGS. 4A and 4B are time charts showing the operation of the vacuum cleaner.
Figure 4B:
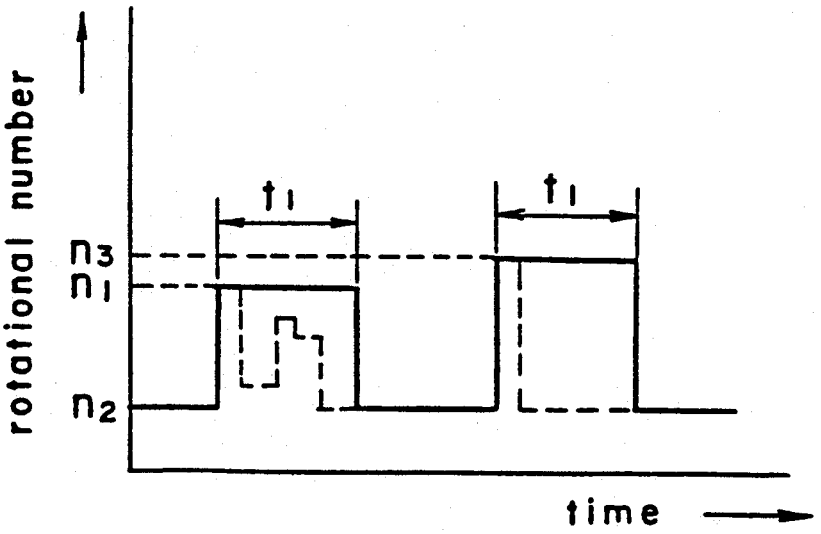

Referring to FIGS. 4A and 4B, the operation of the control apparatus of the vacuum cleaner is described below. When an amount $D_1$ of dust is detected, the fuzzy inferring device 10 performs fuzzy inference in response to signals outputted from the dust amount detecting means 2 and the comparing/counting means 9, thus setting the number of rotations of the motor 4 to $n_1$ as shown in FIG. 4B. Then, the means 11 for holding the number of rotations holds the number of rotations of the motor 4 at $n_1$ for a predetermined period of time $t_1$. The number of rotations thereof determined by fuzzy inference varies according to the change of the amount of dust as shown by a broken line of FIG. 4B, but the actual number of rotations thereof is set to $n_1$ as shown by a solid line. After a predetermined period of time elapses, the motor 4 rotates at the number of rotations $n_2$ determined by fuzzy inference. Similarly, when the detected amount of dust is $D_2$ as shown in FIG. 4A, the number of rotations thereof is set to $n_3$ as shown in FIG. 4B. After the number of rotations thereof is held at $n_3$ for the predetermined period of time $t_1$, the motor 4 rotates at the number of rotations $n_2$, shown by a broken line, determined by fuzzy inference.

According to the vacuum cleaner of the embodiment, after the number of rotations of the motor 4 is held at the number of rotations determined by the fuzzy inferring device 10 for the predetermined period of time, it is driven at the number of rotations which the fuzzy inferring device 10 has determined in response to a signal outputted from the dust amount detecting means 2. Therefore, a sudden change in the number of rotations of the motor 4 is reduced irrespective of the change in the amount of dust and the volume of sound generated can be prevented from changing greatly. Thus, the vacuum cleaner has a favorable operativeness.

Figure 5:
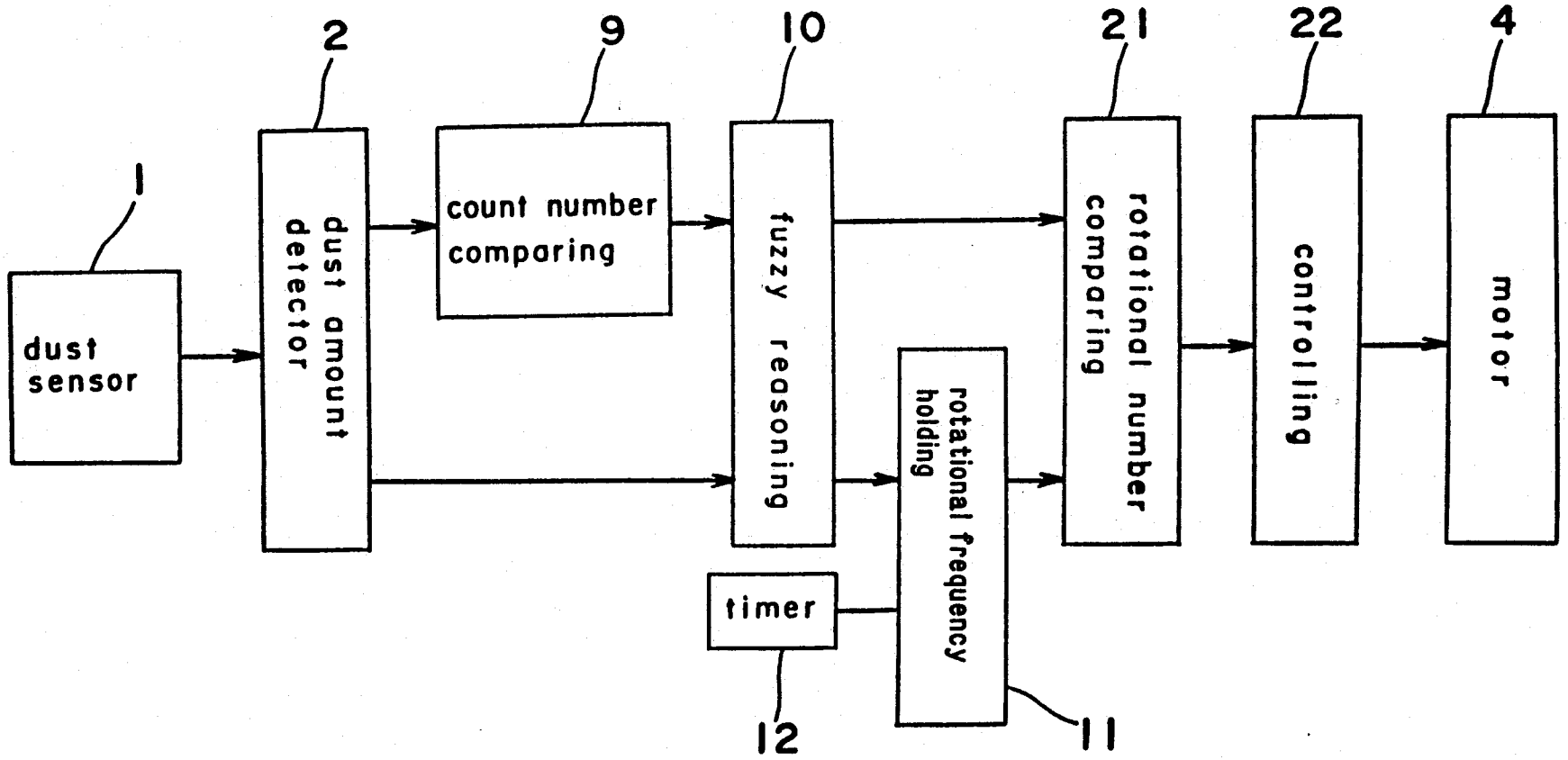
FIG. 5 is a block diagram showing a vacuum cleaner according to another embodiment of the present invention.

Another embodiment of the present invention is described below with reference to FIG. 5.

In response to the output of the fuzzy inferring device 10 and the means 11 for holding the number of rotations, a means 21 for comparing the number of rotations changes the number of rotations of the motor 4 stepwise toward the number of rotations determined by the fuzzy inferring device 10 after a predetermined period of time elapses, thus outputting a signal to a control means 22.

Figure 6A:
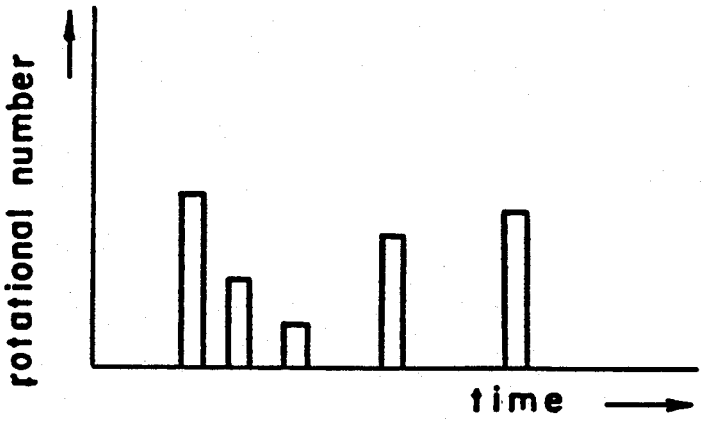
FIGS. 6A, 6B, and 6C are time charts showing the operation of the vacuum cleaner.
Figure 6B:
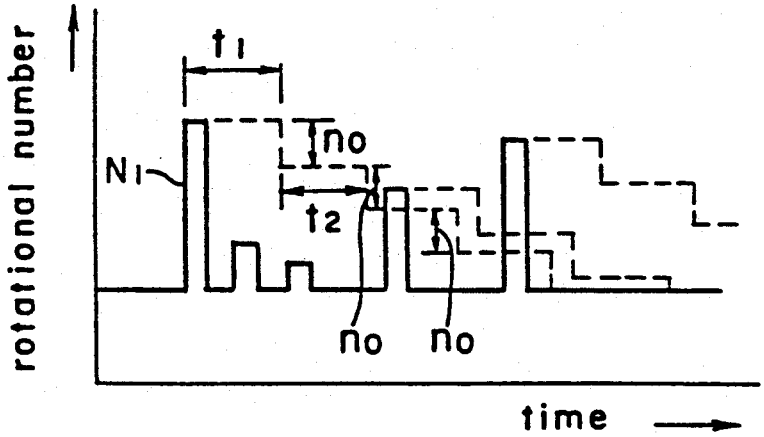
Figure 6C:
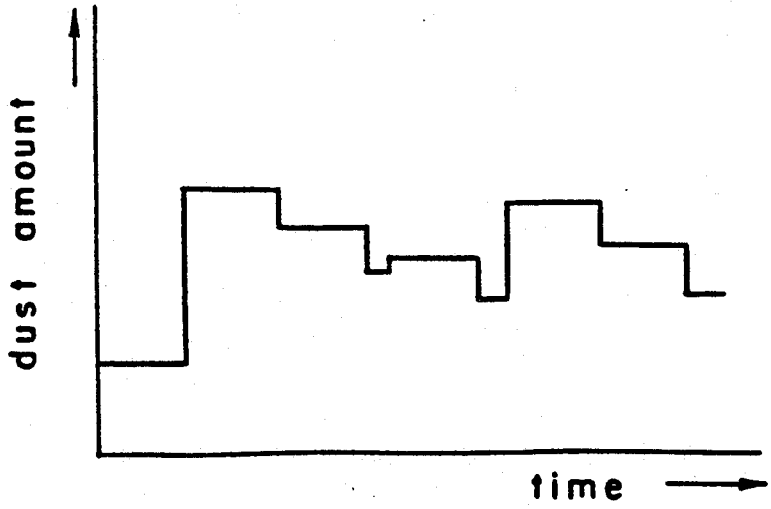
Figure 7:
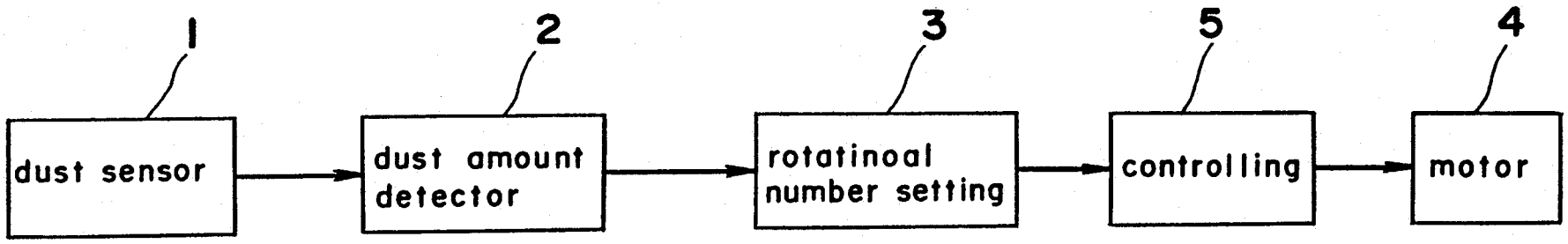
FIG. 7 is a block diagram showing a conventional vacuum cleaner.
Figure 8:
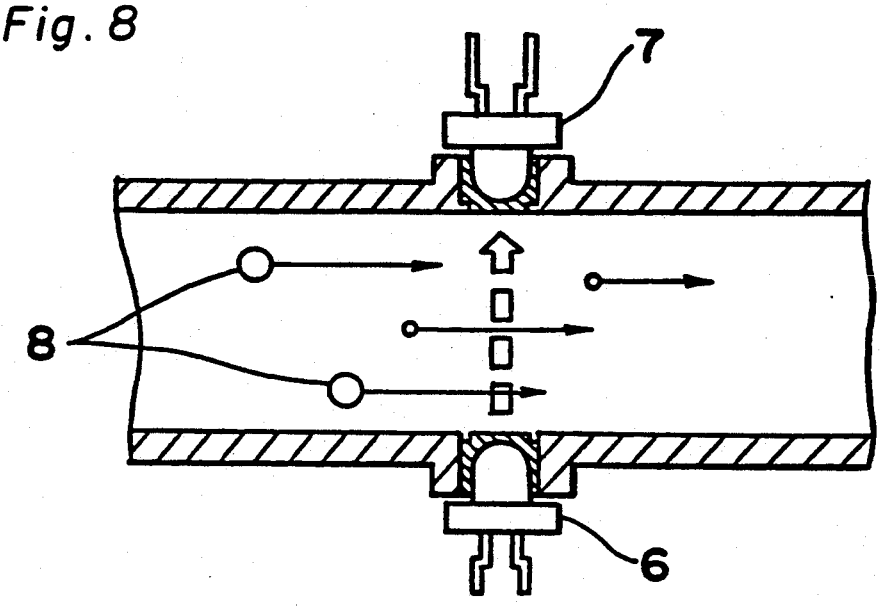
FIG. 8 is a sectional view showing a dust sensor of the conventional vacuum cleaner.
Figure 9A:
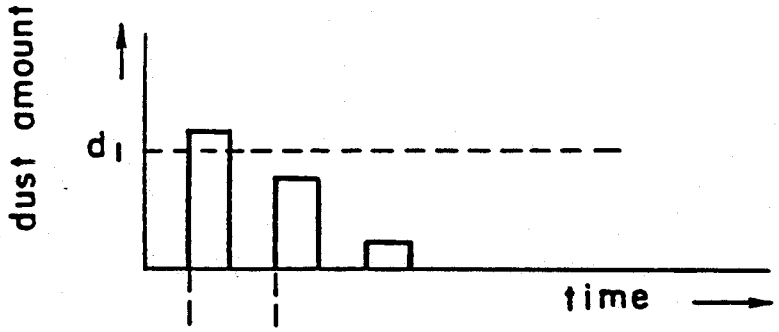
FIGS. 9A and 9B are time charts showing the operation of the conventional vacuum cleaner.
Figure 9B:
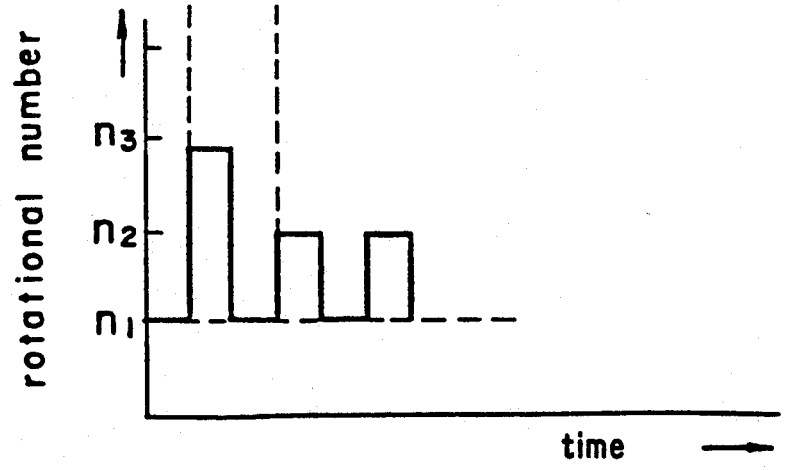

The operation of the vacuum cleaner of this embodiment is described below with reference to FIGS. 6A through 6C. When the amount of dust detected by the comparing/counting means 9 is as shown in FIG. 6A, the fuzzy inferring device 10 determines the number of rotations of the motor 4 at the number of rotations $N_1$ as shown by a solid line of FIG. 6B. An increased number of rotations is kept for the predetermined period of time $t_1$. Then, the number of rotations decreases by $n_o$. Thereafter, the number of rotations decreases by $n_o$ again after a period of time $t_2$ elapses. While the means 11 is holding the number of rotations, the means 21 for comparing the number of rotations compares the number of rotations determined by fuzzy inference and the number of rotations kept by the means 11 with each other, thus determining the number of rotations by selecting the higher number of rotations. Then, the means 21 for comparing the number of rotations outputs a signal to the control means 22. Therefore, when the amount of dust is as shown in FIG. 6A, the motor 4 is driven at the number of rotations as shown by a solid line of FIG. 6C. The variation of the number of rotations of the motor 4 is reduced in the same amount of $n_o$ during the period of times $t_1$ and $t_2$ in the above description, but may be differentiated. Similarly, the period of times $t_1$ and $t_2$ in which number of rotations of the motor 4 is kept to be constant may be same or different.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A vacuum cleaner comprising:

dust amount detecting means or detecting the amount of dust in response to a signal outputted thereto from a sensor provided in an airflow passage and for producing an output;

comparing/counting means for performing a comparison and counting of the amount of dust and for producing an output;

a fuzzy inferring device for determining the speed of a motor in response to the output of said dust amount detecting means and the output of said comparing/counting means and for producing an output; and means for holding the motor speed determined by said fuzzy inferring device for a predetermined period of time and or producing an output;

wherein after the motor speed is held for said predetermined period of time, said motor is driven for a certain period of time at the speed subsequently determined by sad fuzzy inferring device.

2. A vacuum cleaner as defined in claim 1, further comprising:

speed comparing means in response to the output of said fuzzy inferring device and the output of said means for holding the motor speed, for changing said motor speed stepwise toward the motor speed determined by said fuzzy inferring device after the predetermined period of time elapses, wherein the motor speed is changed to 1) the motor speed minus a predetermined step value if the motor speed minus a predetermined step value is greater than the output of the fuzzy inferring device or 2) the output of the fuzzy inferring device if the output of the fuzzy inferring device is greater than the motor speed minus the predetermined step value.

3. A vacuum cleaner comprising:

dust amount detecting means for detecting the amount of dust in response to a signal outputted thereto from a sensor provided in an airflow passage and for producing an output;

comparing/counting means for performing a comparison and counting of the amount of dust and for producing an output;

a fuzzy inferring device for determining the speed of a motor in response to the output of said dust amount detecting means and the output of said comparing/counting means and for producing an output;

means for holding the motor speed determined by said fuzzy inferring device for a predetermined period of time and for producing an output; and speed comparing means, in response to the output of said fuzzy inferring device and the output of said means for holding the motor speed, for immediately changing the motor speed to the output of said fuzzy inferring device if said output of said fuzzy inferring device exceeds the output of said means for holding during the predetermined period of time, wherein after the motor speed is held for said predetermined period of time, said motor is driven for a certain period of time at the motor speed subsequently determined by said fuzzy inferring device.

4. A vacuum cleaner as defined in claim 3 wherein said speed comparing means, in response to the output of said fuzzy inferring device and the output of said means for holding the motor speed, changes the motor speed stepwise toward the motor speed determined by said fuzzy inferring device after the predetermined period of time elapses.

5. A vacuum cleaner as defined in claim 4, wherein the motor speed is changed to 1) the motor speed minus a predetermined step value if the motor speed minus a predetermined step value is greater than the output of the fuzzy inferring device or 2) the output of the fuzzy inferring device if the output of the fuzzy inferring device is greater than the motor speed minus the predetermined step value.

* * * * *